US008402892B1

(12) United States Patent
Scheid et al.

(10) Patent No.: US 8,402,892 B1
(45) Date of Patent: Mar. 26, 2013

(54) SIMULTANEOUS NONELECTRIC PRIMING ASSEMBLY AND METHOD

(75) Inventors: Eric Scheid, Bloomington, IN (US); Brad Moan, Greenwood, IN (US); Thomas Gailey, Spring Lake, NC (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 195 days.

(21) Appl. No.: 12/982,658

(22) Filed: Dec. 30, 2010

(51) Int. Cl.
*C06C 5/06* (2006.01)

(52) U.S. Cl. ..... 102/275.12; 102/275.4; 102/275.5; 102/275.6; 102/275.7; 102/217

(58) Field of Classification Search ..... 102/206, 102/217, 275.4, 275.5, 275.6, 275.7, 275.12, 102/275.11
See application file for complete search history.

(56) References Cited

U.S. PATENT DOCUMENTS

| | | | | |
|---|---|---|---|---|
| 3,896,731 | A | 7/1975 | Kilmer | |
| 4,023,493 | A | 5/1977 | Austin et al. | |
| 4,187,780 | A | 2/1980 | Petruccelli | |
| 4,282,814 | A | 8/1981 | Menz et al. | |
| 4,426,933 | A * | 1/1984 | Yunan | 102/275.3 |
| 4,442,776 | A * | 4/1984 | Jones | 102/275.12 |
| 4,481,884 | A | 11/1984 | Yunan | |
| 4,637,312 | A | 1/1987 | Adams et al. | |
| 4,722,279 | A | 2/1988 | Yunan | |
| 5,012,741 | A * | 5/1991 | Peebles et al. | 102/275.4 |
| 5,171,935 | A | 12/1992 | Michna et al. | |
| 5,204,492 | A | 4/1993 | Jacob et al. | |
| 5,499,581 | A | 3/1996 | Sutula | |
| 5,661,256 | A | 8/1997 | Sutula et al. | |
| 5,665,932 | A | 9/1997 | Viljoen et al. | |
| 5,708,228 | A | 1/1998 | Sutula et al. | |
| 5,747,722 | A | 5/1998 | Gladden et al. | |
| 5,792,975 | A * | 8/1998 | Tseka et al. | 102/275.7 |
| 6,305,287 | B1 | 10/2001 | Capers et al. | |
| 6,425,332 | B1 | 7/2002 | Capers et al. | |
| 6,513,437 | B2 | 2/2003 | Chan et al. | |
| 6,681,701 | B2 | 1/2004 | Perry | |
| 7,000,545 | B2 * | 2/2006 | Sansolo | 102/331 |
| 7,086,335 | B2 | 8/2006 | O'Brien et al. | |
| 7,188,566 | B2 | 3/2007 | Gladden | |
| 7,661,365 | B2 * | 2/2010 | Chan | 102/275.12 |
| 7,699,004 | B2 | 4/2010 | Muro | |

(Continued)

FOREIGN PATENT DOCUMENTS

EP 0083165 7/1983

OTHER PUBLICATIONS

Owen Oil Tools LP, "Redundant Annulus Pressure Firing System" [MAN-TC-021 (Ros)] brochure, 2009, 20 pages, downloaded on Oct. 13, 2010 from http://www.corelab.com/pe/owen/CMS/PDF/Manuals/tcp/MAN-TC-021.pdf.

*Primary Examiner* — James Bergin
(74) *Attorney, Agent, or Firm* — Christopher A. Monsey

(57) ABSTRACT

A priming assembly and a method are provided for coupling a plurality of detonators to at least one explosive through a plurality of transmission lines. The priming assembly may include a housing that receives the plurality of detonators and the plurality of transmission lines. In use, the plurality of transmission lines may communicate with the plurality of detonators within the housing to transmit explosive charges from the plurality of detonators to the at least one explosive.

18 Claims, 4 Drawing Sheets

U.S. PATENT DOCUMENTS 7,739,954 B2 6/2010 Chan et al.
7,798,065 B2 * 9/2010 Chan et al. ..... 102/275.12
7,891,296 B2 * 2/2011 Husk et al. ..... 102/275.7
2009/0071362 A1 3/2009 Scheid

* cited by examiner

SIMULTANEOUS NONELECTRIC PRIMING ASSEMBLY AND METHOD

STATEMENT REGARDING FEDERALLY SPONSORED RESEARCH OR DEVELOPMENT

The invention described herein includes contributions by one or more employees of the Department of the Navy made in performance of official duties and may be manufactured, used and licensed by or for the United States Government for any governmental purpose without payment of any royalties thereon.

BACKGROUND AND SUMMARY OF THE DISCLOSURE

The present disclosure relates to a priming assembly and a method for coupling a plurality of detonators to at least one explosive through a plurality of transmission lines.

To perform certain mining operations, excavation operations, drilling operations, demolition operations, and military operations, for example, an explosive may be placed at a blasting site. To ensure the safety of a user, the user may trigger and detonate the explosive from a location remote from the blasting site.

According to an illustrative embodiment of the present disclosure, a priming assembly is provided for coupling a plurality of detonators to at least one explosive through a plurality of transmission lines. The priming assembly includes a housing having an outer wall, the housing extending along a longitudinal axis from a first end to a second end. The housing defines a plurality of detonator receptacles that are configured to receive the plurality of detonators and a plurality of transmission line receptacles that are configured to receive the plurality of transmission lines, each of the plurality of transmission line receptacles being semi-circular in shape to retain the plurality of transmission lines and to position the plurality of transmission lines relative to the plurality of detonators in the plurality of detonator receptacles while exposing the plurality of transmission lines to the plurality of detonators in the plurality of detonator receptacles such that an explosive charge from at least one of the plurality of detonators is communicated to the plurality of transmission lines and to the at least one explosive.

According to another illustrative embodiment of the present disclosure, a priming assembly is provided that includes a plurality of detonators, at least one of the plurality of detonators being configured to generate an explosive charge, a plurality of transmission lines, at least one explosive, and a housing having a plurality of detonator receptacles that are sized to receive the plurality of detonators and a plurality of transmission line receptacles that are sized to receive the plurality of transmission lines, each of the plurality of transmission line receptacles being semi-circular in shape to retain the plurality of transmission lines and to position the plurality of transmission lines relative to the plurality of detonators in the plurality of detonator receptacles while exposing the plurality of transmission lines to the plurality of detonators in the plurality of detonator receptacles such that the explosive charge from the at least one detonator is communicated to the plurality of transmission lines and to the at least one explosive.

According to yet another illustrative embodiment of the present disclosure, a method is provided for coupling a first detonator and a second detonator to at least one explosive. The method includes the steps of: providing a housing that includes a first detonator receptacle, a second detonator receptacle, and a plurality of transmission line receptacles, the plurality of transmission line receptacles receiving a plurality of transmission lines; inserting the first detonator into the first detonator receptacle of the housing to communicate with the plurality of transmission lines; inserting the second detonator into the second detonator receptacle of the housing to communicate with the plurality of transmission lines; and coupling the plurality of transmission lines to the at least one explosive.

According to still yet another illustrative embodiment of the present disclosure, a method is provided for manufacturing a priming assembly for coupling a plurality of detonators to at least one explosive through a plurality of transmission lines. The method includes the steps of: forming a housing that includes an outer wall defining an interior of the housing, a plurality of detonator receptacles in the interior of the housing, and a plurality of transmission line receptacles in the interior of the housing, the plurality of detonator receptacles being sized to receive the plurality of detonators and the plurality of transmission line receptacles being sized to receive the plurality of transmission lines, at least one of the plurality of transmission line receptacles communicating with the plurality of detonator receptacles within the housing; and inserting the plurality of transmission lines into the plurality of transmission line receptacles in the housing, at least one of the plurality of transmission lines communicating with the plurality of detonator receptacles within the housing.

BRIEF DESCRIPTION OF THE DRAWINGS

The above-mentioned and other features and advantages of this invention, and the manner of attaining them, will become more apparent and the invention itself will be better understood by reference to the following description of embodiments of the invention taken in conjunction with the accompanying drawings, wherein.

Corresponding reference characters indicate corresponding parts throughout the several views. The exemplifications set out herein illustrate exemplary embodiments of the invention and such exemplifications are not to be construed as limiting the scope of the invention in any manner.

DETAILED DESCRIPTION OF THE DRAWINGS

Figure 1:
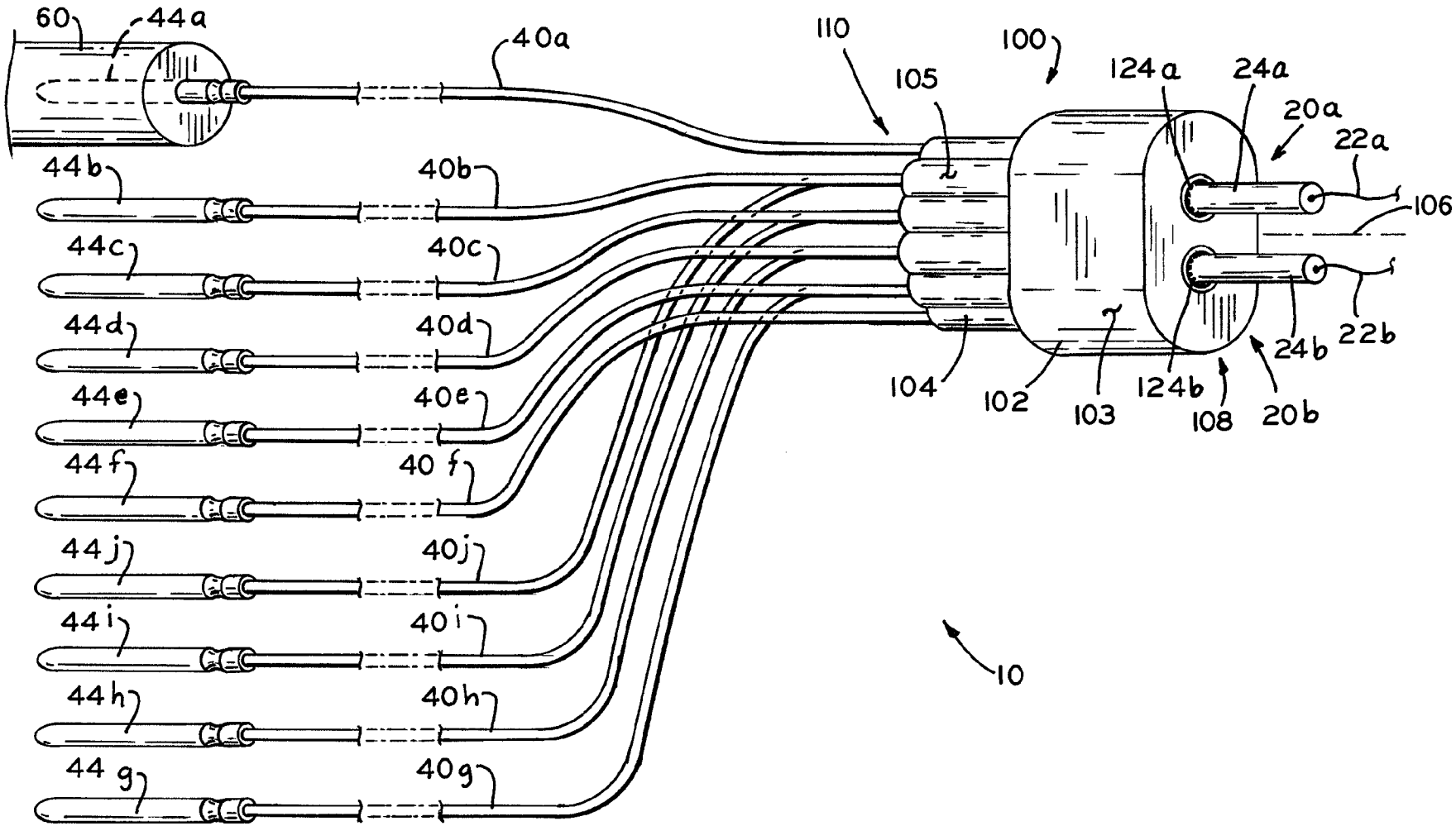
FIG. 1 is a front, assembled perspective view of an illustrative embodiment priming assembly that includes a housing for coupling a plurality of detonators to at least one explosive through a plurality of transmission lines.

Referring to FIG. 1, a priming assembly 10 is provided that includes a housing 100 for coupling a plurality of detonators 20 to at least one explosive 60 through a plurality of nonelectric transmission lines 40. Although only a single explosive 60 is shown in FIG. 1, it is within the scope of the present disclosure that priming assembly 10 may include a plurality of explosives 60, with each explosive 60 being coupled to a corresponding transmission line 40.

In use, a signal is sent to detonate or trigger both detonators 20. If both detonators 20 detonate substantially simultaneously (i.e., within 0.000001 seconds of one another), explosive charges from both detonators 20 may pass simultaneously to the plurality of transmission lines 40 in housing 100. Even if one detonator 20 should fail, the explosive charge from the functioning detonator 20 may still pass simultaneously to the plurality of transmission lines 40 in housing 100. For example, if the detonators 20 do not detonate substantially simultaneously (i.e., within 0.000001 seconds of one another), the first detonator will consume the second detonator, but the explosive charge from the first, functioning detonator may still pass to the plurality of transmission lines 40 in housing 100. The explosive charge from one or both detonators 20 is conveyed or transmitted along transmission lines 40 to explosives 60, which may be located at a remote blasting site, causing explosives 60 to detonate. In this embodiment, housing 100 may enable multiple transmission lines 40, and in turn multiple explosives 60, to detonate substantially simultaneously (e.g., within microseconds of one another), even when one detonator 20 may fail. Advantageously, housing 100 may accomplish this task reliably, safely, under potentially adverse weather conditions, nonelectrically, and/or inexpensively.

If priming assembly 10 were to include a single detonator 20, instead of the plurality of detonators 20 of FIG. 1, a dangerous condition may result if that single detonator 20 failed. For example, a user would need to use extreme care and caution when handling the failed detonator 20 to avoid an unwanted detonation of detonator 20 and/or explosive 60. On the other hand, by providing priming assembly 10 with a plurality of detonators 20, the likelihood that at least one of the plurality of detonators 20 will function properly increases.

The illustrative embodiment priming assembly 10 includes two (2) detonators 20*a*, 20*b*, although the number of detonators 20 may vary. For example, it is within the scope of the present disclosure that priming assembly 10 may include three (3), four (4), or more detonators 20.

Figure 2:
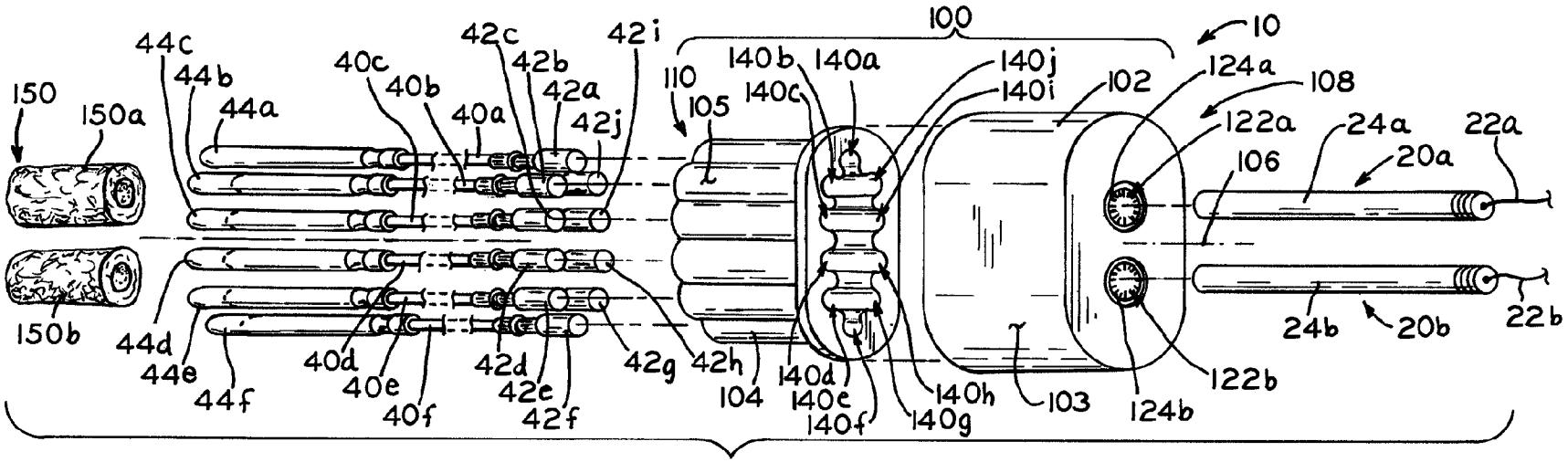
FIG. 2 is a front, exploded perspective view of the priming assembly of FIG. 1, also showing a booster material that is located within the housing.

Detonators 20*a*, 20*b*, may also be referred to as "blasting caps." As shown in FIG. 2, each detonator 20*a*, 20*b*, includes a corresponding signal line 22*a*, 22*b*, and casing 24*a*, 24*b*. Casing 24*a*, 24*b*, of each detonator 20*a*, 20*b*, contains a relatively sensitive, primary explosive material (not shown), which is less stable, and therefore easier to ignite, than the secondary explosive material (not shown) contained in explosives 60. Because detonators 20*a*, 20*b*, may easily ignite, detonators 20*a*, 20*b*, should be stored apart from explosives 60.

The types of detonators 20*a*, 20*b*, used with priming assembly 10 may vary. Suitable detonators 20*a*, 20*b*, include, for example, non-electric caps, electric caps which are triggered by an electric current, and fuse caps which are triggered with a match or another heat source. An illustrative detonator 20 is the MK 17 Electric Blasting Cap which is triggered by an electric current.

The primary explosive material contained in detonators 20*a*, 20*b*, may also vary. Suitable primary explosive materials for use in detonators 20*a*, 20*b*, include, for example, pentaerythritol tetranitrate (PETN), cyclotrimethylenetrinitramine (RDX), mercury fulminate, lead azide, lead styphnate, tetryl, and diazodinitrophenol (DDNP).

Additionally, the illustrative embodiment priming assembly 10 includes ten (10) nonelectric transmission lines 40*a*-40*j*, although the number of transmission lines 40 may vary. For example, it is within the scope of the present disclosure that priming assembly 10 may include two (2), three (3), four (4), five (5), six (6), seven (7), eight (8), nine (9), eleven (11), twelve (12), thirteen (13), fourteen (14), or more transmission lines 40. In certain embodiments, the number of transmission lines 40 may vary based on the number of explosives 60 provided.

Transmission lines 40*a*-40*j* may be provided in the form of "detonating cords" or "detcords," for example, that are produced in accordance with the cut-off characteristics of PER14000035C, paragraph 3.5.1.1.2. Transmission lines 40*a*-40*j* may also be provided in the form of "shocktubes." Each transmission line 40*a*-40*j* may include a flexible, hollow tube that contains a secondary explosive material (not shown). The secondary explosive material in each transmission line 40*a*-40*j* may convey or transmit the explosive charges from one or both detonators 20*a*, 20*b*, to explosives 60, allowing transmission lines 40*a*-40*j* to act as high-speed fuses.

The type and quantity of the secondary explosive material contained in transmission lines 40*a*-40*j* may vary. In the case of "detonating cords," a suitable secondary explosive material for use in transmission lines 40*a*-40*j* includes, for example, pentaerythritol tetranitrate (PETN). In the case of "shocktubes," a suitable secondary explosive material for use in transmission lines 40*a*-40*j* includes, for example, a mixture of cyclotetramethylene-tetranitramine (HMX) and aluminum. Also, suitable transmission lines 40*a*-40*j* may contain 5 grains of explosive per foot, for example, although it is also within the scope of the present disclosure that transmission lines 40*a*-40*j* may contain 0.1 grains of explosive per foot, 2.5 grains of explosive per foot, 7.5 grains of explosive per foot, 10 grains of explosive per foot, or 50 grains of explosive per foot, for example.

The speed at which an explosive charge travels through each transmission line 40*a*-40*j* may be substantially consistent. For example, in the case of "detonating cords," the explosive charge may consistently travel through each transmission line 40*a*-40*j* at a speed between about 6,000 m/s and 6,800 m/s, and in the case of "shocktubes", the explosive charge may consistently travel through each transmission line 40*a*-40*j* at a speed of about 2,000 m/s. By providing transmission lines 40*a*-40*j* of different lengths, a user may detonate multiple explosives 60 at different, yet controlled, times. For example, the user may detonate multiple explosives 60 in a specific order to control the collapse of a building. By providing transmission lines 40*a*-40*j* of the same length, on the other hand, the user may detonate multiple explosives 60 substantially simultaneously. Alternatively, a user may control the timing of detonating multiple explosives 60 using suitable delay detonators.

As shown in FIG. 2, each transmission line 40*a*-40*j* includes a corresponding, optional seal 42*a*-42*j* coupled to one end (i.e., the end closest to housing 100) and a corresponding cartridge 44*a*-44*j* coupled to the other end (i.e., the end closest to explosives 60). In certain embodiments, such as when transmission lines 40*a*-40*j* are provided in the form of "detonating cords," cartridges 44*a*-44*j* may be provided in the form of booster cartridges that contain a secondary explosive material (e.g., pentaerythritol tetranitrate (PETN)). In other embodiments, such as when transmission lines 40*a*-40*j* are provided in the form of "shocktubes," cartridges 44*a*-44*j* may be provided in the form of nonelectric detonator cartridges that contain both a primary explosive material and a secondary explosive material. Each booster cartridge 44*a*-44*j* may act as a bridge between its corresponding transmission line 40*a*-40*j* and explosive 60. As an alternative to seals 42*a*-42*j*, it is also within the scope of the present disclosure that, on the end closest to housing 100, each transmission line 40*a*-40*j* may include a second cartridge similar to cartridges 44*a*-44*j* to act as a bridge between detonators 20*a*, 20*b*, and its corresponding transmission line 40*a*-40*j*.

The illustrative embodiment priming assembly 10 further includes one or more explosives 60. In certain embodiments, each transmission line 40 is coupled to its own individual explosive 60. For example, because the illustrative embodiment priming assembly 10 of FIG. 1 has ten (10) transmission lines 40*a*-40*j*, ten (10) explosives 60 may be provided, with each transmission line 40*a*-40*j* being coupled to its own individual explosive 60 (although only a single explosive 60 is shown in FIG. 1). In other embodiments, more than one transmission lines 40*a*-40*j* may be coupled to a single explosive 60.

In use, explosives 60 may be placed at a blasting site. For example, explosives 60 may be placed at the site of an excavation operation, a drilling operation, a demolition operation, a military operation, or another suitable operation. Transmission lines 40*a*-40*j* span between detonators 20*a*, 20*b*, and explosives 60, allowing the user to safely trigger detonators 20*a*, 20*b*, at a location remote from the blasting site.

As discussed above, each explosive 60 may contain a relatively stable, secondary explosive material (not shown). The secondary explosive material contained in explosives 60 may vary. Suitable secondary explosive materials for use in explosives 60 include, for example, cyclotrimethylenetrinitramine (RDX), cyclotetramethylene-tetranitramine (HMX), and trinitrotoluene (TNT).

Figure 3:
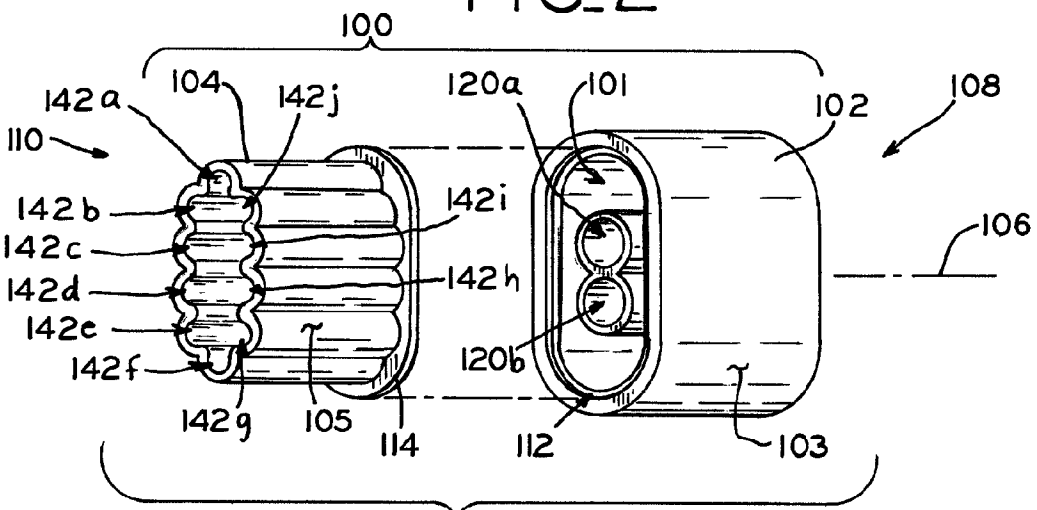
FIG. 3 is a rear, exploded perspective view of the housing of FIG. 3.
Figure 4:
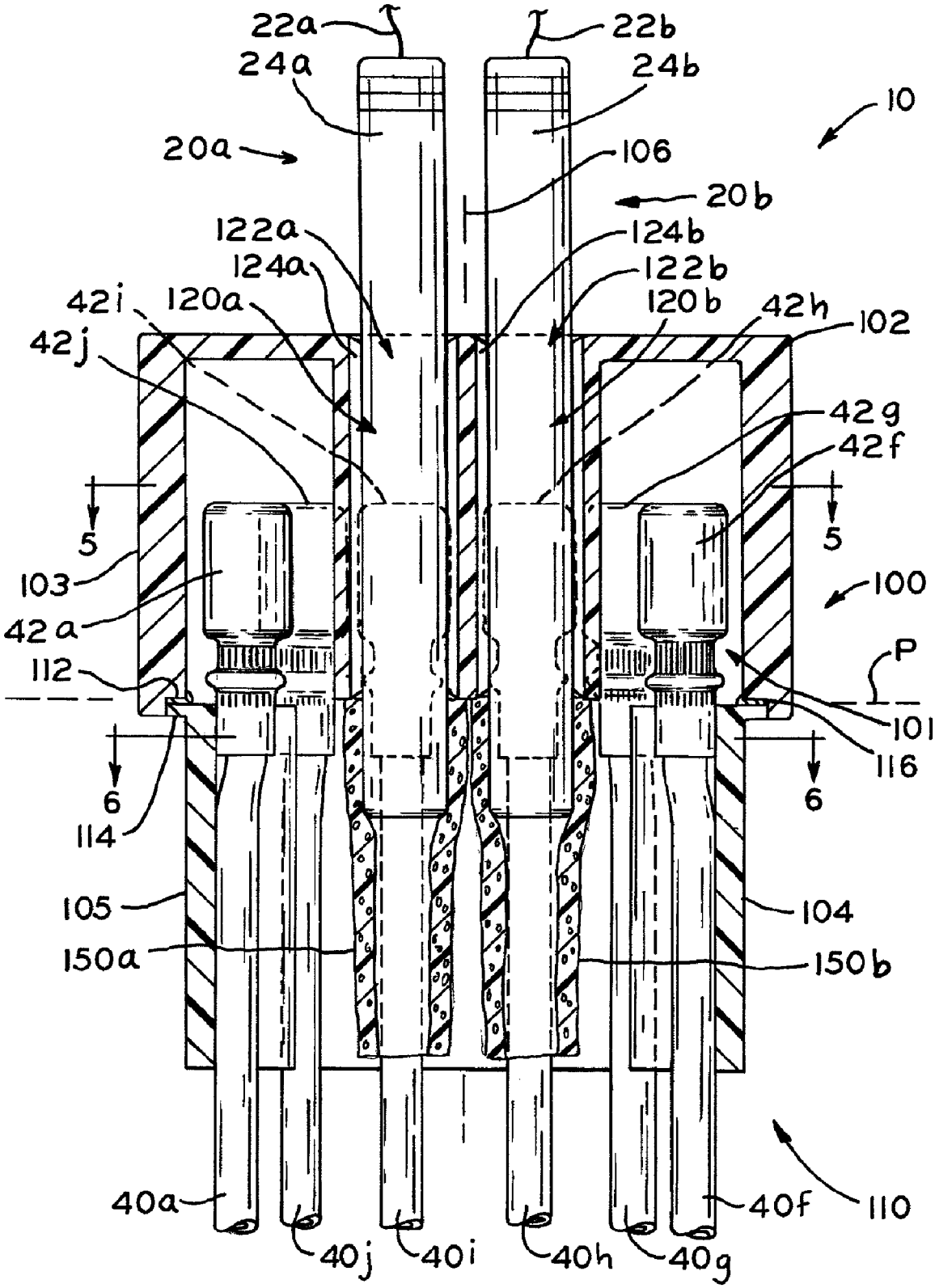
FIG. 4 is a cross-sectional view of the priming assembly of FIG. 1.

Referring next to FIGS. 2-4, the illustrative housing 100 of priming assembly 10 is a multi-piece construct having first portion 102 that receives the plurality of detonators 20 and second portion 104 that receives the plurality of transmission lines 40. However, it is also within the scope of the present disclosure that housing 100 may be a one-piece, unitary construct.

First portion 102 of housing 100 includes outer wall 103 and second portion 104 of housing 100 includes outer wall 105. When assembled, as shown in FIG. 4, outer walls 103, 105, of first and second portions 102, 104, cooperate to define interior 101 of housing 100 that is at least partially hollow. Housing 100 extends along longitudinal axis 106 from input end 108 to output end 110.

As shown in FIG. 4, first portion 102 of housing 100 defines recess 112 and second portion 104 of housing 100 includes rim 114 that is sized for receipt within recess 112. In certain embodiments, first and second portions 102, 104, of housing 100 may be coupled together with a suitable adhesive 116, as shown in FIG. 4. In other embodiments, first and second portions 102, 104, of housing 100 may be coupled together with a mechanical fastener, such as a screw (not shown) or a latch (not shown), for example.

Housing 100 of priming assembly 10 may be constructed of a consumable material, such as plastic or rubber, or another suitable material. For example, depending on the amount of fragmentation produced, housing 100 may be constructed of an acrylonitrile butadiene styrene (ABS) thermoplastic, Santoprene™ thermoplastic vulcanised (TPV) rubber, or another suitable material having a hardness of about 80 Durometer. Illustrative methods of manufacturing housing 100 include, for example, injection molding.

First portion 102 of housing 100 defines a plurality of channels or receptacles 120 for receiving and supporting the plurality of detonators 20 therein. In the illustrated embodiment of FIG. 4, for example, first portion 102 of housing 100 defines two (2) receptacles 120*a*, 120*b*, for receiving and supporting detonators 20*a*, 20*b*, respectively. However, it is within the scope of the present disclosure that first portion 102 of housing 100 may define more than two (2) receptacles 120 for receiving more than two (2) detonators 20.

As shown in FIG. 4, receptacles 120*a*, 120*b*, extend entirely through first portion 102 of housing 100 in a direction substantially parallel to one another and to longitudinal axis 106. In other words, receptacles 120*a*, 120*b*, extend from input ports 122*a*, 122*b*, in input end 108 of housing 100 (FIG. 2) toward second portion 104 of housing 100 (FIG. 3). In this way, detonators 20*a*, 20*b*, may be inserted into input ports 122*a*, 122*b*, in input end 108 of housing 100, through receptacles 120*a*, 120*b*, in housing 100, and toward second portion 104 of housing 100.

To enable housing 100 to hold detonators 20 of various shapes and sizes, each receptacle 120*a*, 120*b*, of housing 100 may include an array of radially inwardly extending, flexible fins 124*a*, 124*b*. When smaller diameter detonators 20*a*, 20*b*, are inserted into housing 100, fins 124*a*, 124*b*, may extend radially into each receptacle 120*a*, 120*b*, to grab and hold the respective detonator 20*a*, 20*b*. On the other hand, when larger diameter detonators 20*a*, 20*b*, are inserted into housing 100, fins 124*a*, 124*b*, may flex to increase the effective internal diameter of each receptacle 120*a*, 120*b*, thereby making room for the insertion of each detonator 20*a*, 20*b*, without causing an undue increase in the amount of force applied to each detonator 20*a*, 20*b*. In certain embodiments, fins 124*a*, 124*b*, of each receptacle 120*a*, 120*b*, may be configured to grab and hold detonators having diameters between at least 0.210 inches and 0.300 inches. To enable flexion of fins 124*a*, 124*b*, relative to housing 100, fins 124*a*, 124*b*, may be constructed of a material that is more flexible than housing 100. For example, fins 124*a*, 124*b*, may be constructed of thermoplastic vulcanised (TPV) rubber having a hardness of about 60 Durometer. It is also within the scope of the present disclosure that receptacles 120*a*, 120*b*, of housing 100 may include threaded inserts and priming adapters (not shown) to receive and hold detonators 20*a*, 20*b*.

Second portion 104 of housing 100 defines a plurality of channels or receptacles 140 for receiving and supporting the plurality of transmission lines 40 therein and for positioning transmission lines 40 relative to detonators 20. In the illustrated embodiment of FIG. 4, for example, second portion 104 of housing 100 defines ten (10) receptacles 140*a*-140*j* for receiving and supporting transmission lines 40*a*-40*j*, respectively. However, it is within the scope of the present disclosure that second portion 104 of housing 100 may define fewer than ten (10) receptacles 140 for receiving fewer than ten (10) transmission lines 40, or that second portion 104 of housing 100 may define more than ten (10) receptacles 140 for receiving more than ten (10) transmission lines 40.

As shown in FIG. 4, receptacles 140*a*-140*j* extend entirely through second portion 104 of housing 100 in a direction substantially parallel to one another and to longitudinal axis 106. In other words, receptacles 140*a*-140*j* extend from first portion 102 of housing 100 (FIG. 2) toward output ports 142*a*-142*j* in output end 110 of housing 100 (FIG. 3). In certain embodiments, and as shown in FIG. 4, seals 42*a*-42*j* of transmission lines 40*a*-40*j* may be sized larger than receptacles 140*a*-140*j* to prevent transmission lines 40*a*-40*j* from withdrawing from housing 100 through output ports 142*a*-142*j* in output end 110 of housing 100.

Figure 5:
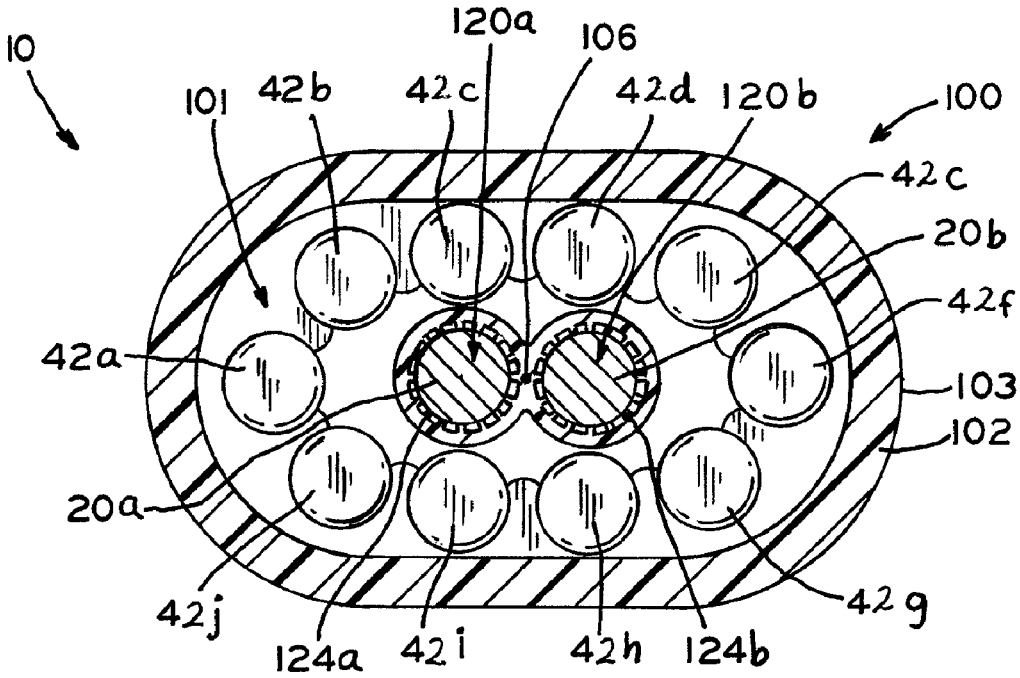
FIG. 5 is a cross-sectional view of the priming assembly of FIG. 4, taken along line 5-5 of FIG. 4.
Figure 6:
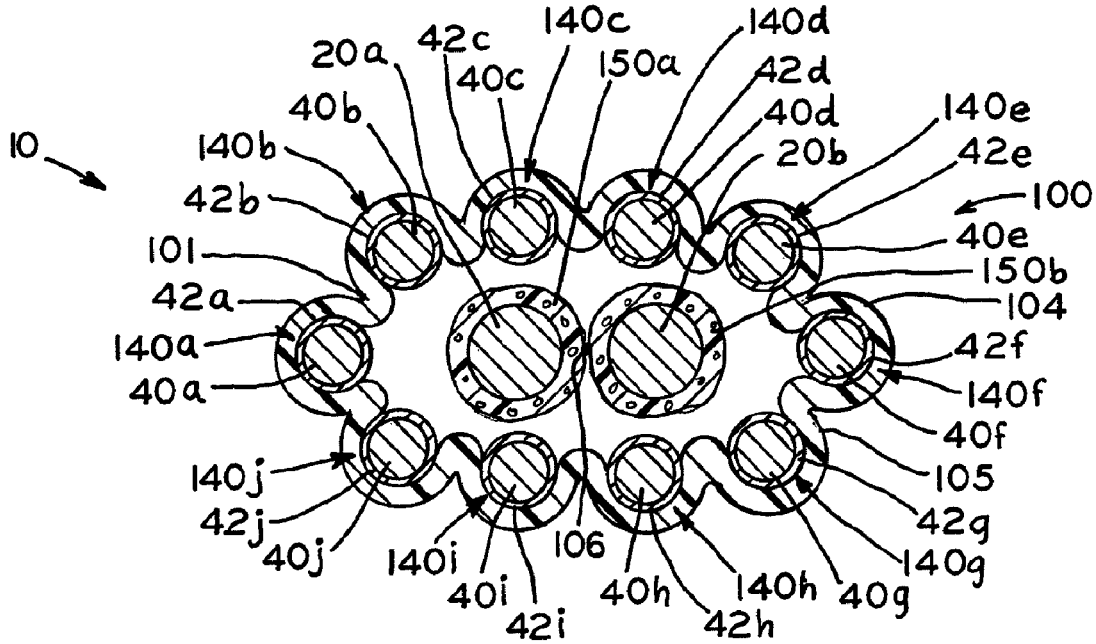
FIG. 6 is another cross-sectional view of the priming assembly of FIG. 4, taken along line 6-6 of FIG. 4.

According to an exemplary embodiment of the present disclosure, receptacles 140*a*-140*j* in second portion 104 of housing 100 may be semi-circular and partially open (FIG. 6). Receptacles 140*a*-140*j* may adequately surround transmission lines 40*a*-40*j* to retain transmission lines 40*a*-40*j* therein while preventing lateral removal of transmission lines 40*a*-40*j* from receptacles 140*a*-140*j*. To achieve such retention, receptacles 140*a*-140*j* may surround more than 180 degrees of each transmission line 40*a*-40*j*. On the other hand, receptacles 140*a*-140*j* may be at least partially open, leaving transmission lines 40*a*-40*j* exposed to the explosive charge from detonators 20*a*, 20*b*. To achieve such exposure, receptacles 140*a*-140*j* may surround less than 360 degrees of each transmission line 40*a*-40*j*. For example, exemplary receptacles 140*a*-140*j* may surround about 190 degrees, 200 degrees, or 210 degrees of each transmission line 40*a*-40*j*. Receptacles 120*a*, 120*b*, in first portion 102 of housing 100, on the other hand, may be circular to fully surround or encircle each detonator 20*a*, 20*b* (FIG. 5).

When priming assembly 10 is assembled, transmission lines 40*a*-40*j* may surround detonators 20*a*, 20*b*, as shown in FIG. 5, which is a cross-section taken in a direction perpendicular to longitudinal axis 106. In other words, detonators 20*a*, 20*b*, may extend centrally through housing 100 near longitudinal axis 106, and transmission lines 40*a*-40*j* may be located radially outwardly from detonators 20*a*, 20*b*, and longitudinal axis 106.

Additionally, when priming assembly 10 is assembled, detonators 20*a*, 20*b*, and transmission lines 40*a*-40*j* may longitudinally overlap in a direction perpendicular to longitudinal axis 106, as shown in FIG. 4. For example, detonators 20*a*, 20*b*, may extend beyond the interfacing plane P between first and second portions 102, 104, of housing 100 (i.e., the interfacing plane P that contains adhesive layer 116) and into second portion 104 of housing 100 along with transmission lines 40*a*-40*j*. Similarly, seals 42*a*-42*j* may longitudinally overlap detonators 20*a*, 20*b*, in the direction perpendicular to longitudinal axis 106, as shown in FIG. 4. For example, seals 42*a*-42*j* may extend beyond interfacing plane P and into first portion 102 of housing 100 along with detonators 20*a*, 20*b*.

To ensure that the explosive charge from the detonators 20*a*, 20*b*, is effectively conveyed or transmitted to transmission lines 40*a*-40*j*, housing 100 may include or be packed with a booster material 150, such as DETAPRIME, which is a flexible material that includes pentaerythritol tetranitrate (PETN). Booster material 150 may amplify or "boost" the energy released by detonators 20*a*, 20*b*, to ensure that sufficient energy is delivered to detonate transmission lines 40*a*-40*j* and, in turn, to detonate cartridges 44*a*-44*j* and explosives 60. The quantity of booster material 150 provided in housing 100 and the distance, if any, separating booster material 150 from detonators 20*a*, 20*b*, and/or transmission lines 40*a*-40*j* may vary to achieve an effective communication of the explosive charge from detonators 20*a*, 20*b*, to transmission lines 40*a*-40*j*.

Booster material 150 may surround receptacles 120*a*, 120*b*, in first portion 102 of housing 100 and/or may extend between receptacles 140*a*-140*j* in second portion 104 of housing 100. In the illustrated embodiment of FIGS. 2 and 4, for example, booster material 150 includes two (2), hollow tubes 150*a*, 150*b*, located between receptacles 140*a*-140*j* in second portion 104 of housing 100, each booster tube 150*a*, 150*b*, configured to receive a corresponding detonator 20*a*, 20*b*, therein. Because transmission lines 40*a*-40*j* may be surrounded by receptacles 140*a*-140*j* on one side (i.e., the side closest to outer wall 105) and exposed on the other side (i.e., the side closest to the hollow interior 101 of housing 100), transmission lines 40*a*-40*j* may be exposed to booster material 150.

The manner in which booster material 150 is retained within housing 100 may vary. In certain embodiments, booster material 150 may be retained within housing 100 by way of a friction-fit with detonator 20*a*, 20*b*, transmission lines 40*a*-40*j*, and/or part of housing 100. In other embodiments, booster material 150 may be retained within housing 100 using a suitable adhesive, for example. In still other embodiments, booster material 150 may be retained within housing 100 by at least partially covering or enclosing output end 110 of housing 100.

Priming assembly 10 may be at least partially pre-assembled before supplying priming assembly 10 to a user. For example, as shown in FIG. 4, transmission lines 40*a*-40*j* may be inserted into receptacles 140*a*-140*j* of housing 100 before supplying priming assembly 10 to the user. Also, housing 100 may be packed with booster material 150 before supplying priming assembly 10 to the user. After inserting transmission lines 40*a*-40*j* and/or booster material 150 into housing 100, first and second portions 102, 104, of housing 100 may be coupled together, such as with a suitable adhesive 116, to close housing 100. In this way, the user may only need to insert detonators 20*a*, 20*b*, into housing 100 and couple transmission lines 40*a*-40*j* to explosives 60, as shown in FIG. 1. It is also within the scope of the present disclosure that booster material 150 may be inserted into housing 100 along with or after detonators 20*a*, 20*b*.

While this invention has been described as having preferred designs, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A priming assembly for coupling a plurality of detonators to at least one explosive through a plurality of transmission lines, the priming assembly comprising:

a housing having an outer wall, the housing extending along a longitudinal axis from a first end to a second end, the housing defining:

a plurality of detonator receptacles that are configured to receive the plurality of detonators; and a plurality of transmission line receptacles that are configured to receive the plurality of transmission lines, each of the plurality of transmission line receptacles being semi-circular in shape to retain the plurality of transmission lines and to position the plurality of transmission lines relative to the plurality of detonators in the plurality of detonator receptacles while exposing the plurality of transmission lines to the plurality of detonators in the plurality of detonator receptacles such that an explosive charge from at least one of the plurality of detonators is communicated to the plurality of transmission lines and to the at least one explosive.

2. The priming assembly of claim 1, wherein the explosive charge from the at least one detonator is communicated simultaneously to the plurality of transmission lines.

3. The priming assembly of claim 1, wherein each of the plurality of detonator receptacles extends parallel to the longitudinal axis of the housing.

4. The priming assembly of claim 1, wherein each of the plurality of transmission line receptacles extends parallel to the longitudinal axis of the housing.

5. The priming assembly of claim 1, wherein the plurality of detonator receptacles extend parallel to the plurality of transmission line receptacles.

6. The priming assembly of claim 1, wherein the plurality of transmission line receptacles surround the plurality of detonator receptacles.

7. The priming assembly of claim 1, wherein the plurality of transmission line receptacles surround more than 180 degrees and less than 360 degrees of each transmission line.

8. The priming assembly of claim 1, wherein the first end of the housing defines the plurality of detonator receptacles and the second end of the housing defines the plurality of transmission line receptacles.

9. The priming assembly of claim 1, wherein the plurality of transmission line receptacles and the plurality of detonator receptacles are aligned along a plane that extends perpendicular to the longitudinal axis of the housing.

10. The priming assembly of claim 1, wherein the number of transmission line receptacles in the housing exceeds the number of detonator receptacles in the housing.

11. The priming assembly of claim 1, further comprising a booster material within the housing that produces an explosive coupling effect between the plurality of transmission line receptacles and the plurality of detonator receptacles to communicate the explosive charge from the at least one detonator to the plurality of transmission lines.

12. The priming assembly of claim 1, wherein the housing includes a first portion and a second portion distinct from the first portion, the first portion of the housing defining a recess and the second portion of the housing including a rim that is sized for receipt within the recess.

13. A priming assembly comprising:

a plurality of detonators, at least one of the plurality of detonators being configured to generate an explosive charge;

a plurality of transmission lines;

at least one explosive; and a housing comprising:

a plurality of detonator receptacles that are sized to receive the plurality of detonators; and a plurality of transmission line receptacles that are sized to receive the plurality of transmission lines, each of the plurality of transmission line receptacles being semi-circular in shape to retain the plurality of transmission lines and to position the plurality of transmission lines relative to the plurality of detonators in the plurality of detonator receptacles while exposing the plurality of transmission lines to the plurality of detonators in the plurality of detonator receptacles such that the explosive charge from the at least one detonator is communicated to the plurality of transmission lines and to the at least one explosive.

14. The priming assembly of claim 13, wherein the plurality of transmission lines are nonelectric.

15. The priming assembly of claim 13, wherein the plurality of detonators contain a more sensitive, primary explosive material and the at least one explosive contains a more stable, secondary explosive material.

16. The priming assembly of claim 13, further comprising a booster material within the housing that produces an explosive coupling effect between the plurality of transmission line receptacles and the plurality of detonator receptacles to communicate the explosive charge from the at least one detonator to the plurality of transmission lines.

17. The priming assembly of claim 13, further comprising a plurality of flexible fins that extend radially into the plurality of detonator receptacles of the housing.

18. The priming assembly of claim 13, wherein the plurality of transmission lines include enlarged heads that prevent longitudinal removal of the plurality of transmission lines from the plurality of transmission line receptacles.

* * * * *